US007080747B2

(12) United States Patent
Lane et al.

(10) Patent No.: US 7,080,747 B2
(45) Date of Patent: Jul. 25, 2006

(54) LIGHTWEIGHT CONTAINER

(75) Inventors: Michael T. Lane, Brooklyn, MI (US); Daniel W. Gamber, Lakeland, TN (US)

(73) Assignee: Amcor Limited, Abbotsford (AU)

( * ) Notice: Subject to any disclaimer, the term of this patent is extended or adjusted under 35 U.S.C. 154(b) by 201 days.

(21) Appl. No.: 10/756,208

(22) Filed: Jan. 13, 2004

(65) Prior Publication Data

US 2005/0150859 A1 Jul. 14, 2005

(51) Int. Cl.
*B65D 1/02* (2006.01)
*B65D 1/40* (2006.01)

(52) U.S. Cl. ..... 215/381; 215/384; 220/669; 220/675

(58) Field of Classification Search ..... 215/381, 215/383, 384, 900, 398; 220/666, 669, 675, 220/671
See application file for complete search history.

(56) References Cited

U.S. PATENT DOCUMENTS

| | | | | |
|---|---|---|---|---|
| D295,376 | S | 4/1988 | Rogler | |
| 5,199,588 | A * | 4/1993 | Hayashi | 215/381 |
| 5,261,543 | A | 11/1993 | Ugarelli | |
| 5,279,433 | A * | 1/1994 | Krishnakumar et al. | 215/381 |
| 5,303,834 | A * | 4/1994 | Krishnakumar et al. | 215/381 |
| 5,704,503 | A * | 1/1998 | Krishnakumar et al. | 215/381 |
| D393,802 | S | 4/1998 | Collette et al. | |
| 6,016,932 | A | 1/2000 | Gaydosh et al. | 215/382 |
| 6,213,326 | B1 * | 4/2001 | Denner et al. | 215/383 |
| 6,223,920 | B1 * | 5/2001 | Lane et al. | 215/384 |
| 6,497,333 | B1 | 12/2002 | Ellis et al. | 215/383 |
| D491,812 | S * | 6/2004 | Eberle et al. | D9/516 |
| 2001/0035392 | A1 * | 11/2001 | Ota et al. | 215/381 |
| 2001/0037992 | A1 * | 11/2001 | Tanabe et al. | 215/384 |
| 2002/0000421 | A1 * | 1/2002 | Ota et al. | 215/381 |
| 2002/0104820 | A1 * | 8/2002 | Hong et al. | 215/381 |
| 2004/0129598 | A1 * | 7/2004 | Zhang et al. | 206/524.8 |

* cited by examiner

*Primary Examiner*—Sue A. Weaver
(74) *Attorney, Agent, or Firm*—Harness, Dickey & Pierce, P.L.C.

(57) ABSTRACT

A hot fill, blow molded plastic container adapted for vacuum pressure absorption and top load force enhancement having a waist region, and generally rectangular shaped vacuum panels and columns equidistantly spaced about the container. The waist region being movable to accommodate top load forces. The vacuum panels being movable to accommodate internal thermally induced volumetric and pressure variations in the container resulting from heating and cooling of its contents.

23 Claims, 6 Drawing Sheets

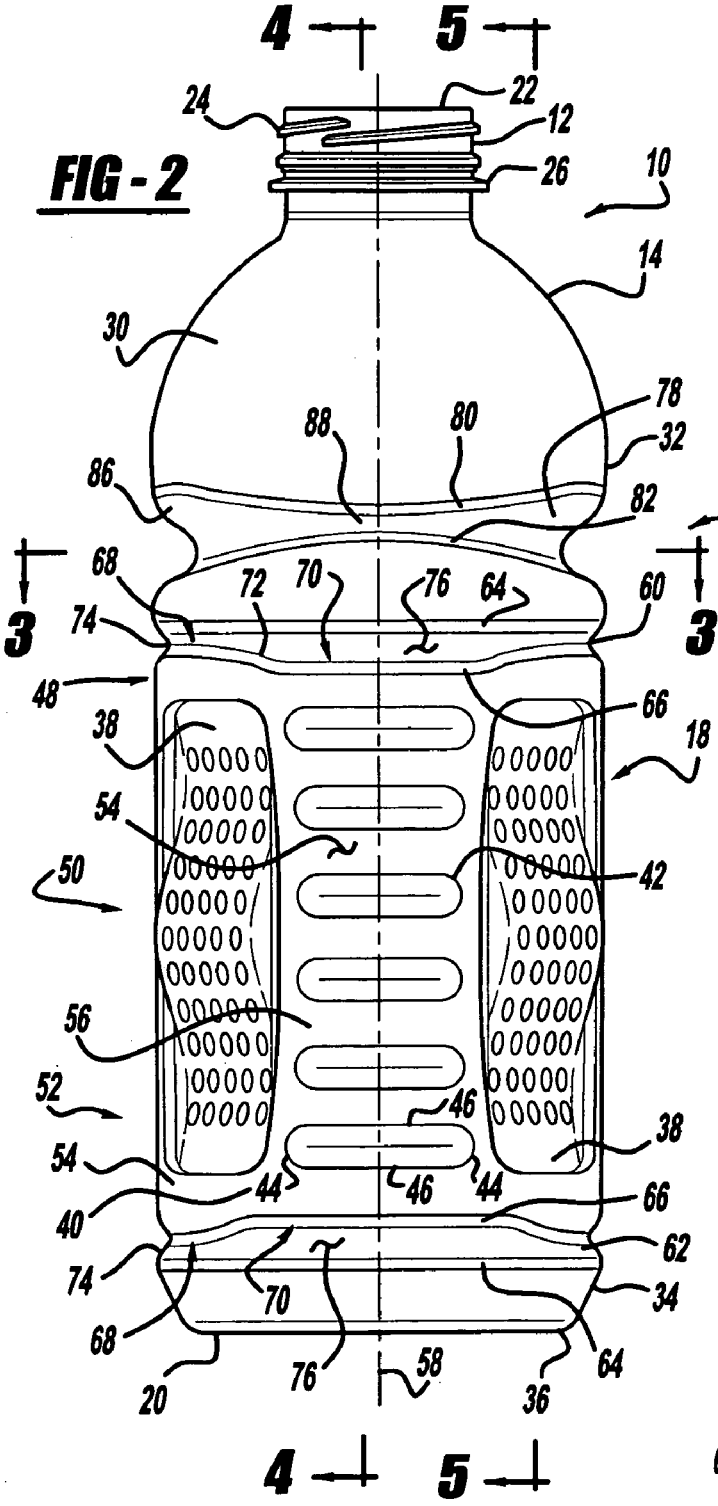
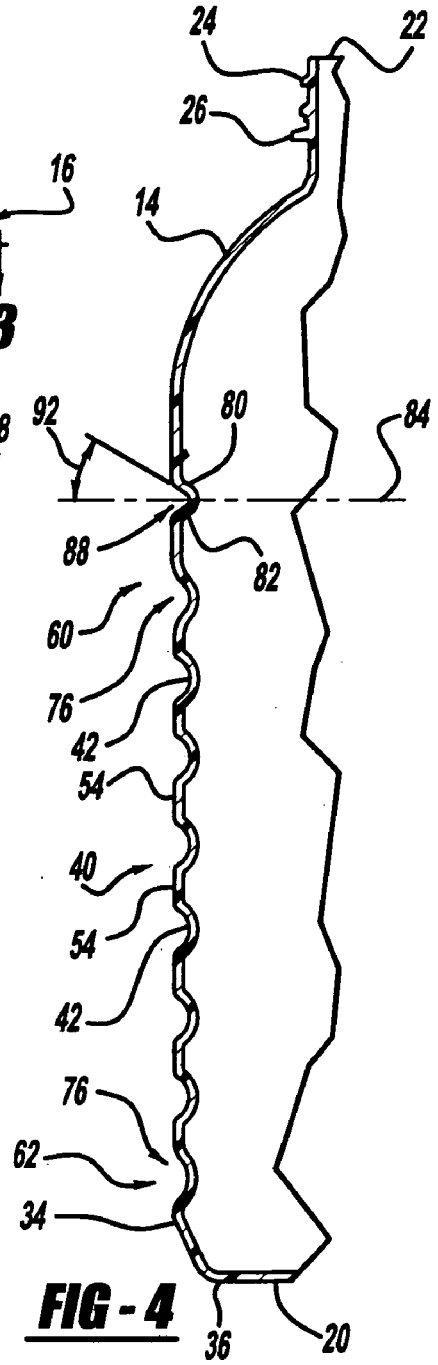
FIG - 4

LIGHTWEIGHT CONTAINER

TECHNICAL FIELD OF THE INVENTION

This invention generally relates to plastic containers that retain a commodity. More specifically, this invention relates to a blow molded plastic container having a novel construction allowing for significant absorption of vacuum pressures and accommodating reductions in product volume while resisting undesirable and unwanted deformation, significant enhanced top load strength performance, and improved empty container packout.

BACKGROUND OF THE INVENTION

Traditionally, containers used for the storage of products for human consumption were made of glass. Typical desirable glass characteristics include transparency, indeformability and perfect label fixation. Nevertheless, because glass is fragile, easily breakable and heavy, it has become cost prohibitive, due to the high number of bottle breaks during handling. Moreover, as a result of breakage preventive measures and weight, the transportation expenses associated with glass greatly increases the cost of the product.

Numerous commodities previously supplied in glass containers are now being supplied in plastic containers, more specifically polyester and even more specifically polyethylene terephthalate (PET) containers. Manufacturers and fillers, as well as consumers, have recognized that PET containers are lightweight, inexpensive, recyclable and manufacturable in large quantities.

Manufacturers currently supply PET containers for various liquid commodities, such as beverages. Often these liquid products, such as juices and isotonics, are filled into the containers while the liquid product is at an elevated temperature, typically 68° C.–96° C. (155° F.–205° F.) and usually about 85° C. (185° F.). When packaged in this manner, the hot temperature of the liquid commodity is used to sterilize the container at the time of filling. This process is known as "hot filling". The containers designed to withstand the process are known as "hot fill" or "heat set" containers.

The use of blow molded plastic containers for packaging hot fill beverages is well known. However, a container that is used for hot fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot fill liquid is introduced into the container. After being hot filled, the heat set containers are capped and allowed to reside at generally about the filling temperature for approximately five (5) minutes. The container, along with the product, is then actively cooled so that the filled container may be transferred to labeling, packaging and shipping operations. As the liquid cools, it shrinks in volume. Thus, upon cooling, the volume of the liquid in the container is reduced. This product shrinkage phenomenon results in the creation of a negative pressure or vacuum within the container. Generally, this negative pressure or vacuum within the container ranges from 1–300 mm Hg less than atmospheric pressure (i.e., 759 mm Hg–460 mm Hg). If not controlled or otherwise accommodated, these negative pressures or vacuums result in deformation of the container which leads to either an aesthetically unacceptable container or one which is unstable. The container must be able to withstand such changes in pressure without failure.

Hot filling is an acceptable process for commodities having a high acid content. Non-high acid content commodities, however, must be processed in a different manner. Nonetheless, manufacturers and fillers of non-high acid content commodities desire to supply their commodities in PET containers as well.

For non-high acid content commodities, pasteurization and retort are the preferred sterilization process. Pasteurization and retort both present an enormous challenge for manufactures of PET containers in that heat set containers usually cannot withstand the temperature and time demands required for pasteurization and retort.

Pasteurization and retort are both processes for cooking or sterilizing the contents of a container after it has been filled. Both processes include the heating of the contents of the container to a specified temperature, usually above about 70° C. (about 155° F.), for a specified length of time (20–60 minutes). Retort differs from pasteurization in that higher temperatures are used, as is an application of pressure externally to the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. The percentage of crystallinity is characterized as a volume fraction by the equation:

$$\%\ \text{Crystallinity} = \frac{\rho - \rho_a}{\rho_c - \rho_a} \times 100$$

where ρ is the density of the PET material; $\rho_a$ is the density of pure amorphous PET material (1.333 g/cc); and $\rho_c$ is the density of pure crystalline PET material (1.455 g/cc).

The crystallinity of a PET container can be increased by mechanical processing and by thermal processing. Mechanical processing involves orienting the amorphous material to achieve strain hardening. Such mechanical processing commonly involves stretching a PET preform along a longitudinal axis and expanding the PET preform along a transverse or radial axis to form a PET container. The combination promotes what is known as biaxial orientation of the molecular structure in the container. Manufacturers of PET containers currently use mechanical processing to produce PET containers having about 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of about 120° C.–130° C. (about 248° F.–266° F.), and holding the blown container against the heated mold for about three (3) seconds. Manufacturers of PET juice bottles, which must be hot filled at about 85° C. (185° F.), currently use heat setting to produce PET bottles having an overall container crystallinity in the range of 25–30%.

Due to the relative high cost of PET material, even slight increases in the weight of the material of the container will result in an excessive increase in its cost, making it less competitive in relation to the glass bottle, thereby resulting in the infeasibility of such a solution to the problem. Additionally, in many instances, container weight is correlated to the amount of the final vacuum present in the container after this fill, cap and cool down procedure. In order to reduce container weight, i.e., "lightweight" the container, thus providing a significant cost savings from a material standpoint, the amount of the final vacuum must be reduced. Typically, the amount of the final vacuum can be reduced through various processing options such as the use of nitrogen dosing technology or reduce fill temperatures. One drawback with the use of nitrogen dosing technology however is that the maximum line speeds achievable with the current technology is limited to roughly 200 containers per minute. Such slower line speeds are seldom acceptable. Additionally, the dosing consistency is not yet at a technological level to achieve efficient operations. Reducing fill temperatures limits the type of commodity capable of being used and thus is equally disadvantageous.

The above described negative pressure or vacuum within the container has typically been accommodated by the incorporation of structures in the sidewall of the container. These structures are commonly known as vacuum panels. Traditionally, these paneled areas have been semi-rigid by design, unable to accommodate the high levels of negative pressure or vacuum currently generated, particularly in lightweight containers. Currently, hot fill containers typically exclusively include substantially rectangular vacuum panels that are designed to collapse inwardly after the container has been filled with hot product. These rectangular vacuum panels are designed so that as product cools, they will deform and move inwardly. While commercially successful, the inward flexing of the rectangular panels caused by the hot fill vacuum creates high stress points at the top and bottom edges of the vacuum panels, especially at the upper and lower corners of the panels. These stress points weaken the portions of the sidewall near the edges of the panels, allowing the sidewall to collapse inwardly during handling of the container or when containers are stacked together.

One way to eliminate the concerns related to the above mentioned stress points is to increase the thickness of the container's sidewall. Such an increase also increases the material cost for the container and the weight of the container, both of which are unacceptable. While other such methods have worked satisfactorily to some extent, none have significantly increased to top load strength capabilities.

As exhibited from the above discussion, the sidewall portion of the container has been given considerable attention in the effort to control the mechanical stresses imposed on the container as a result of the hot-filling process. Little or no consideration has been given to the upper portion of the container, including the waist region of the container.

Containers subjected to the above-described hot filling procedure have exhibited a somewhat limited ability to withstand top loading during filling, capping, labeling and stacking for transporting or storage operations. As a result of the decreased container rigidity immediately after filling and cooling, even heat set containers are less able to resist loads imparted through the top or upper portion of the container, such as when the containers are stacked one upon another for storage and shipping (as is readily understood, it is important to be able to stack containers so as to maximize the use of shipping space). Similar top loads are imparted to the container when it is dropped and lands on the upper portion or mouth of the container. As a result of this type of top loading, the container can become deformed and undesirable to the consumer. A solution to these types of problems is critical as it would decrease the likelihood of a container's top or shoulder being deformed or crushed, as well as inhibiting ovalization in this area.

Thus, there is a need for an improved container which is designed to distort inwardly in a controlled manner under the negative pressure or vacuum which results from hot filling so as to accommodate these negative pressures or vacuums and eliminate undesirable deformation in the container yet which allows for lightweighting, accommodates higher fill temperatures, exhibits enhanced top load strength capabilities and improved empty container packout.

With the foregoing in mind, an object of the present invention is to provide novel hot fillable, lightweight plastic containers which have vacuum absorption panels that flex during hot filling, capping and cooling; which are resistant to unwanted distortion; and which absorb a majority of the negative pressure or vacuum applied to the container.

It is another object of the present invention to provide a hot filled, blow molded, lightweight plastic container which provides improved, increased top loading structural integrity.

It is also an object of the present invention to provide a lightweight container having an upper portion which includes structural characteristics that provide the container with an enhanced top load strength capability and improved empty container packout.

In function of the above mentioned qualities, associated with its transparency, the proposed lightweight container is an extremely inexpensive and efficient means for the container user to promote its product, thus contributing to reinforce the good image of its company in the market. It is therefore an object of this invention to provide such a container.

SUMMARY OF THE INVENTION

Accordingly, this invention provides for a plastic container which maintains aesthetic and mechanical integrity during any subsequent handling after being hot filled and cooled to ambient having a structure that is designed to distort inwardly in a controlled manner so as to allow for significant absorption of negative pressure or vacuum within the container without unwanted deformation and significantly enhanced top load strength capabilities.

In achieving the above and other objects, the present invention includes a hot fillable, blow molded plastic container having an upper portion, a sidewall portion and a base. The upper portion includes an opening defining a mouth of the container and a modulating waist region. The sidewall portion extends from the upper portion to the base. The sidewall portion defined in at least part by generally rectangular shaped vacuum panels and columns. The modulating waist region being movable to accommodate top load forces. The vacuum panels being moveable to accommodate vacuum forces generated within the container thereby decreasing the volume of the container.

Additional benefits and advantages of the present invention will become apparent to those skilled in the art to which the present invention relates from the subsequent description of the preferred embodiment and the appended claims, taken in conjunction with the accompanying drawings.

BRIEF DESCRIPTION OF THE DRAWINGS

FIG. 2 is a side elevational view of the container illustrated in FIG. 1.

FIG. 4 is a cross-sectional view of the container taken generally along the line 4—4 of FIG. 2.

DETAILED DESCRIPTION OF THE PREFERRED EMBODIMENT

Figure 1:
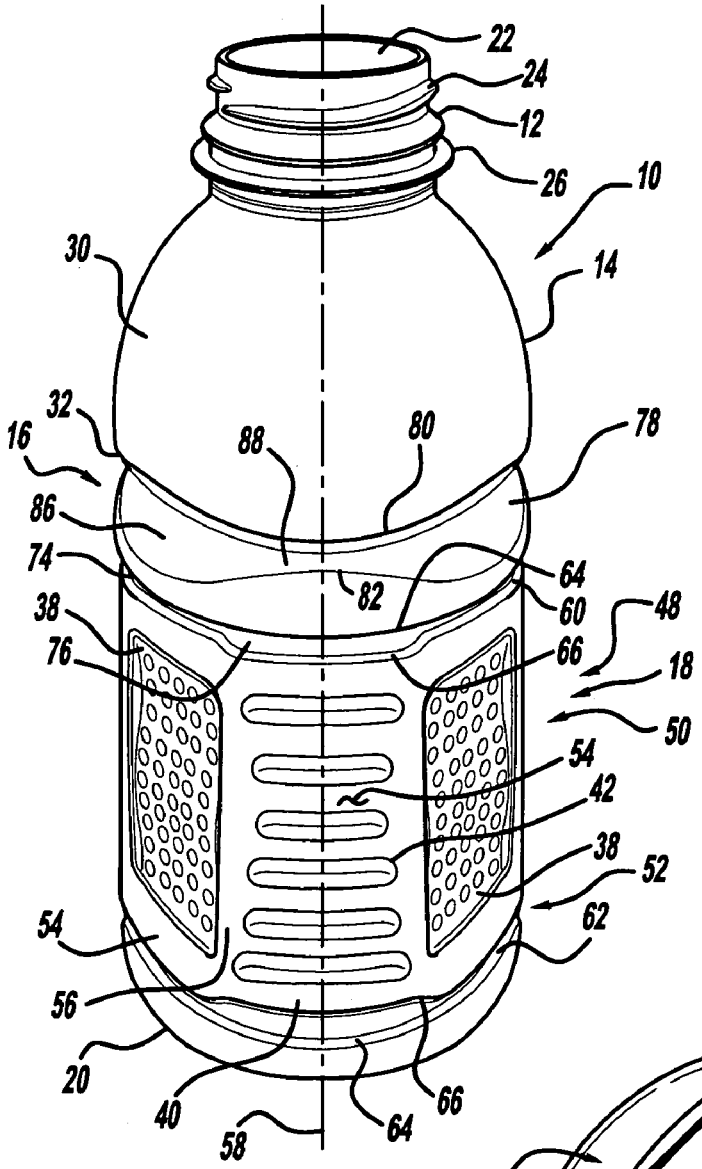
FIG. 1 is a perspective view of a container embodying the principles and constructed in accordance with the teachings of a preferred embodiment of the present invention.

The following description of the preferred embodiment is merely exemplary in nature, and is in no way intended to limit the invention or its application or uses.

As discussed above, to accommodate vacuum forces during cooling of the contents within a hot fill or heat set container, containers have been provided with a series of vacuum panels around their sidewalls. Traditionally, these vacuum panels have been semi-rigid and incapable of preventing unwanted distortion elsewhere in the container, particularly in lightweight containers. Such containers have also exhibited a somewhat limited ability to withstand top loading during filling, capping, labeling and stacking for transportation or storage operations. Little or no consideration has been given to the upper portion of the container, including the waist region of the container in an attempt to resolve these concerns.

Referring now to the drawings, there is depicted a hot fillable, blow molded plastic container 10 embodying the principles and concepts of the present invention. The container 10 of the present invention illustrated in FIGS. 1–7 is particularly suited for hot fill packaging of product, typically a liquid or beverage, while the product is in a heated state. The container 10 has also been specifically designed for retaining a commodity during a thermal process, such as a high-temperature pasteurization or retort. The container 10 may also be used for retaining a commodity during other thermal processes as well. The container 10 can be filled by automated, high speed hot fill equipment known in the art. After filling, the container is sealed and cooled. The unique construction of the container 10 enables it to accommodate vacuum-induced volumetric shrinkage caused by hot filling and provide enhanced top load strength capabilities. While designed for use in hot fill or thermal process applications, it is noted that the container 10 is also acceptable for non-hot fill or non-thermal process applications. The teachings of the present invention are more broadly applicable to a large range of plastic containers.

The disclosed container structures can be made by stretch blow molding from an injection molded preform of any of several well known plastic materials. Accordingly, the plastic container 10 of the present invention is a blow molded, biaxially oriented container with an unitary construction from a single or multi-layer material such as polyethylene terephthalate (PET) resin. Alternatively, the plastic container 10 may be formed by other methods and from other conventional materials including, for example, polyethylene napthalate (PEN), and a PET/PEN blend or copolymer. Such materials have proven particularly suitable for applications involving hot fill processing wherein contents are heated to temperatures greater than 85° C. (185° F.) before the container is capped and allowed to cool to ambient temperature. Plastic containers blow molded with an unitary construction from PET materials are known and used in the art of plastic containers, and their general manufacture in the present invention will be readily understood by a person of ordinary skill in the art.

As illustrated in FIGS. 1–7, the plastic container 10 of the present invention generally includes a finish 12, a shoulder region 14, a waist region 16, a sidewall portion 18 and a base 20.

The finish 12 of the plastic container 10 includes a portion defining an aperture or mouth 22, a threaded region 24 and a support ring 26. The aperture or mouth 22 allows the plastic container 10 to receive a commodity while the threaded region 24 provides a means for attachment of a similarly threaded closure or cap 28, shown in FIG. 6. Alternatives may include other suitable devices which engage the finish 12 of the plastic container 10. Accordingly, the closure or cap 28 functions to engage with the finish 12 so as to preferably provide a hermetical seal for the plastic container 10. The closure or cap 28 is preferably made from a plastic or metal material conventional to the closure industry and suitable for subsequent thermal processing, including high temperature pasteurization and retort. The support ring 26 may be used to carry or orient the preform (the precursor to the plastic container 10) (not shown) through and at various stages of manufacture. For example, the preform may be carried by the support ring 26, the support ring 26 may be used to aid in positioning the preform in the mold, or the support ring 26 may be used by an end consumer to carry the plastic container 10.

Integrally formed with the finish 12 and extending downward therefrom is the shoulder region 14. The shoulder region 14 is circular in transverse cross-section adjacent to the waist region 16 and defines a maximum diameter of the container 10 at this point. The shoulder region 14 includes a label mounting area 30. A label can be applied to the label mounting area 30 using methods that are well known to those skilled in the art, including shrink wrap labeling and adhesive methods. As applied, the label can extend around the entire body of the shoulder region 14. While a preferred shoulder region 14 is illustrated in the drawings, other shoulder region configurations can be utilized with the novel features of the present invention.

The shoulder region 14 merges into the waist region 16. The waist region 16 extends inwardly below a label bumper 32 at the lower portion of the shoulder region 14. The waist region 16 pinches inward below the label bumper 32 in order to prevent ovalization of the label mounting area 30 of the shoulder region 14. The waist region 16 provides a transition between the shoulder region 14 and the sidewall portion 18. The sidewall portion 18 extends downward from the waist region 16 to the base 20. The generally cylindrical sidewall portion 18 is constructed so as to accommodate the effects of a decrease in internal pressure within the container 10 as its contents cool. Because of the specific construction of the waist region 16 and the sidewall portion 18, a significantly lightweight container can be formed. Such a container 10 can exhibit at least a ten percent (10%) reduction in weight from those of current stock containers and is extremely capable of accommodating high fill temperatures.

The base 20 of the plastic container 10, which extends inward from the sidewall portion 18, generally includes a chime 34 and a contact ring 36. The base 20 is coaxial with the shoulder region 14, and similar to the shoulder region 14, is circular in transverse cross-section adjacent to the sidewall potion 18 and defines a maximum diameter of the container 10 at this point. The contact ring 36 is itself that portion of the base 20 which contacts a support surface upon which the container 10 is supported. As such, the contact ring 36 may be a flat surface or a line of contact generally circumscribing, continuously or intermittently, the base 20. The base 20 functions to close off the bottom portion of the plastic container 10 and, together with the shoulder region 14, the waist region 16 and the sidewall portion 18, to retain the commodity. While a preferred base 20 is illustrated in the drawings, other base configurations can be utilized with the novel features of the present invention.

Figure 6:
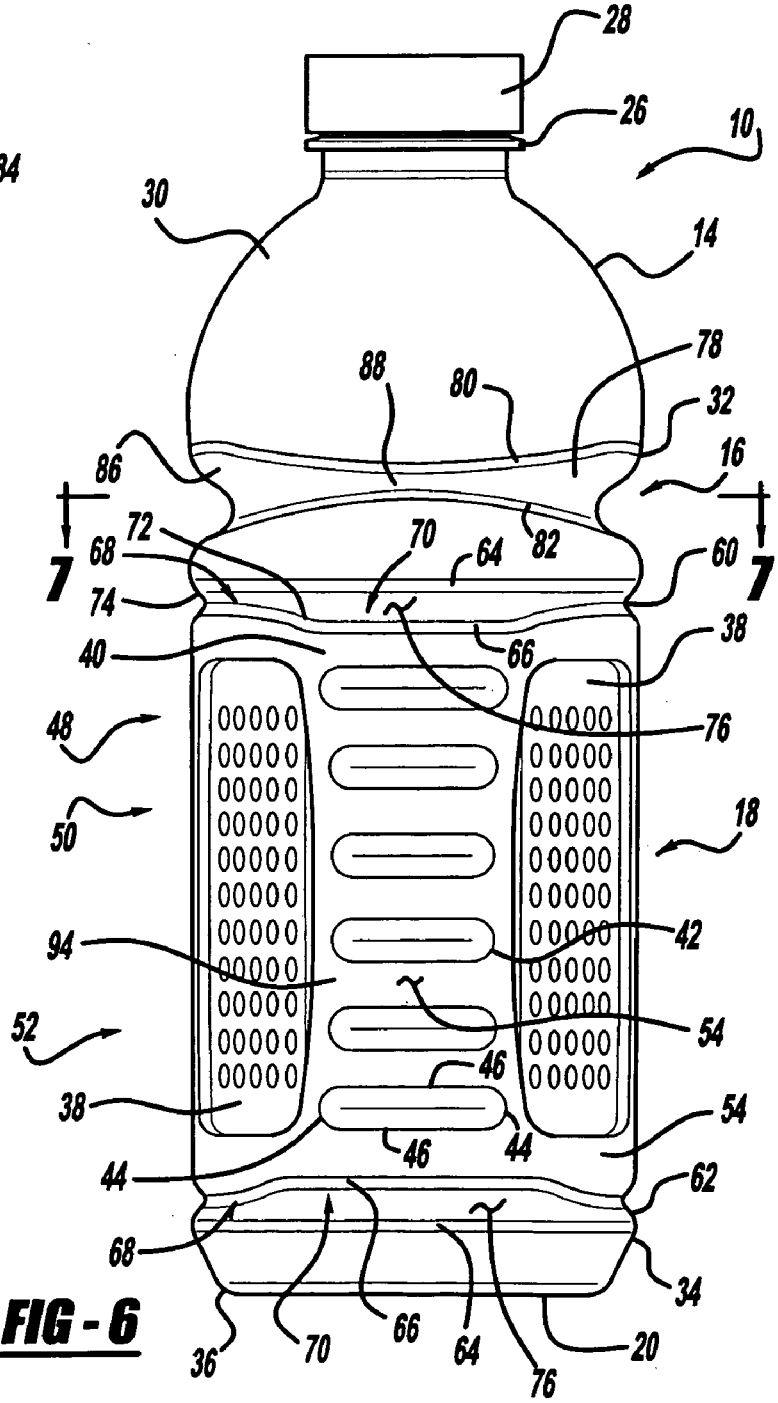
FIG. 6 is a side elevational view of the container illustrated in FIGS. 1 and 2, the container being filled and sealed.

The plastic container 10 is preferably heat set according to the above mentioned process or other conventional heat set processes. To accommodate the negative pressure or vacuum forces within the container 10, the sidewall portion 18 of the present invention adopts a novel and innovative construction. To this end, the sidewall portion 18 includes vacuum panels 38 formed therein. As illustrated in the figures, the vacuum panels 38 are generally rectangular in shape and are shown as being generally equidistantly spaced around the sidewall portion 18 of the container 10. The vacuum panels 38 are separated and interconnected by columns 40. The columns 40 are similarly generally equidistantly spaced around the sidewall portion 18 of the container 10. While such spacing is preferred, other factors such as labeling requirements or the incorporation of grip features into the container may require a spacing other than equidistant. The container illustrated in FIGS. 1, 2 and 6 show a container 10 having three (3) vacuum panels 38 and three (3) columns 40. It is equally contemplated that less than this amount be required. Thus, the innovative technology associated with the present invention eliminates three (3) of the six (6) vacuum panels traditionally found on hot filled containers. Together, the vacuum panels 38 and the columns 40 form a continuous integral circumferential sidewall portion 18. Accordingly, the sidewall portion 18 appears to be substantially circular in transverse cross-section at its upper and lower portions.

As illustrated in FIGS. 1, 2, 5 and 6, the vacuum panels 38 of the present invention are similar in appearance and function to those set forth and described in commonly owned application No. 10/361,356, filed on Feb. 10, 2003, the entire disclosure of which is incorporated herein by reference.

As illustrated in FIGS. 1, 2, 4 and 6, the columns 40 extend continuously in a longitudinal direction from the waist region 16 to the base 20. The columns 40 include a series of indents 42. The indents 42 are generally oval in shape having two half circular end portions 44 separated by two horizontal portions 46. The indents 42 extend continuously in a longitudinal direction from the waist region 16 to the base 20. The length of each indent 42 varies in an oscillating type fashion. That is, beginning at an upper portion 48 of the sidewall portion 18, the length of each indent 42 gradually decreases proceeding downward until at a midsection portion 50 of the sidewall portion 18. Thereafter, continuing proceeding downward, the length of each indent 42 increases until reaching a lower portion 52 of the sidewall portion 18. Accordingly, the length of the indents 42 located at the upper portion 48 and the lower portion 52 of the sidewall portion 18 are the longest. While the indents 42 located at the midsection portion 50 of the sidewall portion 18 are the shortest. Defined between each adjacent vacuum panel 38 and each horizontal indent 42 are lands 54. The lands 54 provide additional structural support and rigidity to the sidewall portion 18 of the container 10.

The columns 40 unique construction adds structure, support and strength to the sidewall portion 18 of the container 10. This added structure and support, resulting from the unique construction of the columns 40, minimizes the outward movement or bowing of the columns 40 during the fill, seal and cool down procedure. Thus, contrary to the vacuum panels 38, the columns 40 maintain their relative stiffness throughout the fill, seal and cool down procedure. The columns 40 provide a slightly outward arcuate first convex shaped surface 56 as formed with the distance from a central longitudinal axis 58 of the container being fairly consistent throughout the entire height of the sidewall portion 18 from the waist region 16 to the base 20. The added structure and strength, resulting from the unique construction of the columns 40, further aids in the transferring of top load forces thus aiding in the prevention of the sidewall portion 18 buckling, creasing and deforming.

The unique construction of the columns 40 aids in providing the container 10 with a more glass like appearance. Additionally, the unique construction of the columns 40 of the container 10 provides additional label support and increases the sidewall portion 18 label panel area of the container 10 by roughly 100%.

As illustrated in FIGS. 1, 2 and 6, and briefly mentioned above, the sidewall portion 18 merges into and is unitarily connected to the waist region 16 and the base 20. Prior to this transition to the waist region 16 and the base 20, the sidewall portion 18 includes, at its upper portion 48 an upper circumferential recess or annular groove 60 and at its lower portion 52 a lower circumferential recess or annular groove 62. The upper circumferential recess or annular groove 60 and the lower circumferential recess or annular groove 62 are mirror images of one another. The upper circumferential recess or annular groove 60 and the lower circumferential recess or annular groove 62 are defined by an outer periphery ridge or wall 64 and an inner periphery ridge or wall 66.

The outer periphery ridge or wall 64 of the upper circumferential recess or annular groove 60 defines the transition between the waist region 16 and the upper circumferential recess or annular groove 60, while the outer periphery ridge or wall 64 of the lower circumferential recess or annular groove 62 defines the transition between the base 20 and the lower circumferential recess or annular groove 62. The inner periphery ridge or wall 66 of the upper circumferential recess or annular groove 60 defines the transition between the upper circumferential recess or annular groove 60 and the lands 54, while the inner periphery ridge or wall 66 of the lower circumferential recess or annular groove 62 defines the transition between the lands 54 and the lower circumferential recess or annular groove 62. Accordingly, the outer periphery ridge or wall 64 and the inner periphery ridge or wall 66 are distinctly identifiable structures and are approximately 0.079 inches (2 mm) to approximately 0.315 inches (8 mm) in height. The above mentioned transitions must be abrupt in order to maximize the localized strength as well as to form a geometrically rigid structure. The resulting localized strength increases the resistance to creasing and buckling of the sidewall portion 18.

The inner periphery ridge or wall 66 of the upper circumferential recess or annular groove 60 and the lower circumferential recess or annular groove 62 include outer plateaued portions 68 and inner plateaued portions 70. The outer plateaued portions 68 and the inner plateaued portions 70 are connected by wall portion 72. The outer plateaued portions 68 are aligned vertically with the vacuum panels 38. The inner plateaued portions 70 are aligned vertically with the columns 40. As illustrated in FIGS. 1, 2 and 6, the outer periphery ridge or wall 64 and the outer plateaued portions 68 define and form converged portions 74 of the upper circumferential recess or annular groove 60 and the lower circumferential recess or annular groove 62. Conversely, the outer periphery ridge or wall 64 and the inner plateaued portions 70 define and form expanded portions 76 of the upper circumferential recess or annular groove 60 and the lower circumferential recess or annular groove 62.

Accordingly, the unique construction of the upper circumferential recess or annular groove 60 and the lower circumferential recess or annular groove 62 creates and provides vertical strength to the sidewall portion 18 thus enhancing the top load strength capabilities of the container 10 by aiding in preventing creasing and buckling of the container 10 when subjected to top load forces. Additionally, the lower circumferential recess or annular groove 62 isolates the base 20 from any sidewall portion 18 movement and creates structure, thus aiding the base 20 in maintaining its roundness after the container 10 is filled, sealed and cooled, increasing stability of the container 10, and minimizing rocking as the container 10 shrinks after initial removal from its mold.

To accommodate top load forces on and provide enhanced top load strength capabilities of the container 10, the waist region 16 of the present invention adopts a novel and innovative construction. As briefly mentioned above, the waist region 16 is located between the shoulder region 14 and the sidewall portion 18. To this end, the waist region 16 can generally be described as a circumferential recess or annular groove 78 formed between an upper periphery ridge or wall 80 and a lower periphery ridge or wall 82. The depth and angle of divergence from a horizontal plane 84 of the upper periphery ridge or wall 80 and the lower periphery ridge or wall 82 vary depending on location. Accordingly, global, widening portions 86 of the circumferential recess or annular groove 78, aligned vertically with the vacuum panels 38, are relatively deep. Conversely, converging portions 88 of the circumferential recess or annular groove 78, aligned vertically with the columns 40, are relatively more shallow. To this end, the length of the upper periphery ridge or wall 80 and the lower periphery ridge or wall 82 at the global portions 86 of the circumferential recess or annular groove 78 are approximately 0.157 inches (4 mm) to approximately 0.315 inches (8 mm), with an angle of divergence 90 from the horizontal plane 84 of approximately 20° to approximately 50°. Conversely, the length of the upper periphery ridge or wall 80 and the lower periphery ridge or wall 82 at the converging portions 88 of the circumferential recess or annular groove 78 are approximately 0.079 inches (2 mm) to approximately 0.315 inches (8 mm), with an angle of divergence 92 from the horizontal plane 84 of approximately 30° to approximately 60°. All of the above and previously mentioned dimensions were taken from a typical twenty (20) fluid ounce hot fillable container. It is contemplated that comparable dimensions are attainable for containers of varying shapes and sizes.

As illustrated in FIGS. 1, 2 and 6, the global portions 86 and the converging portions 88 of the circumferential recess or annular groove 78 are, similar to the vacuum panels 38 and the columns 40, spaced generally equidistantly around the container 10. Thus, the waist region 16 of the container 10 has been described as a tri-global modulating waist region. While such spacing is preferred, other features of the container may require a spacing other than equidistant. It is equally contemplated that more or less than the illustrated number of global portions or converging portions be required.

Figure 3:
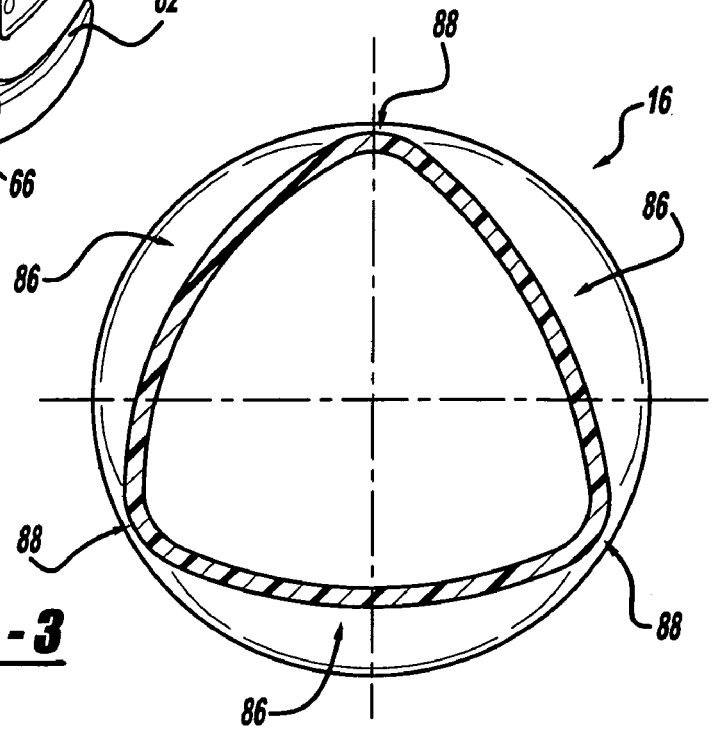
FIG. 3 is a cross-sectional view of the container taken generally along the line 3—3 of FIG. 2.
Figure 5:
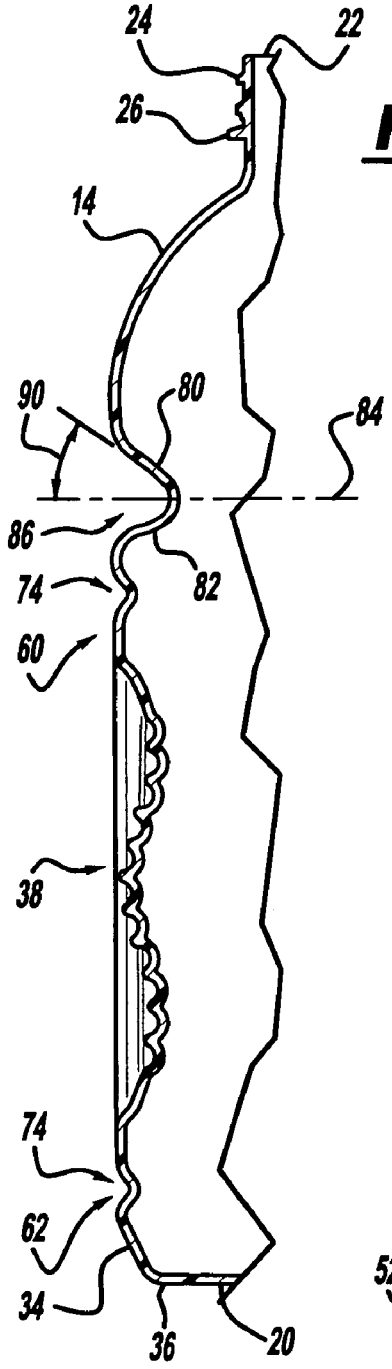
FIG. 5 is a cross-sectional view of the container taken generally along the line 5—5 of FIG. 2.
Figure 7:
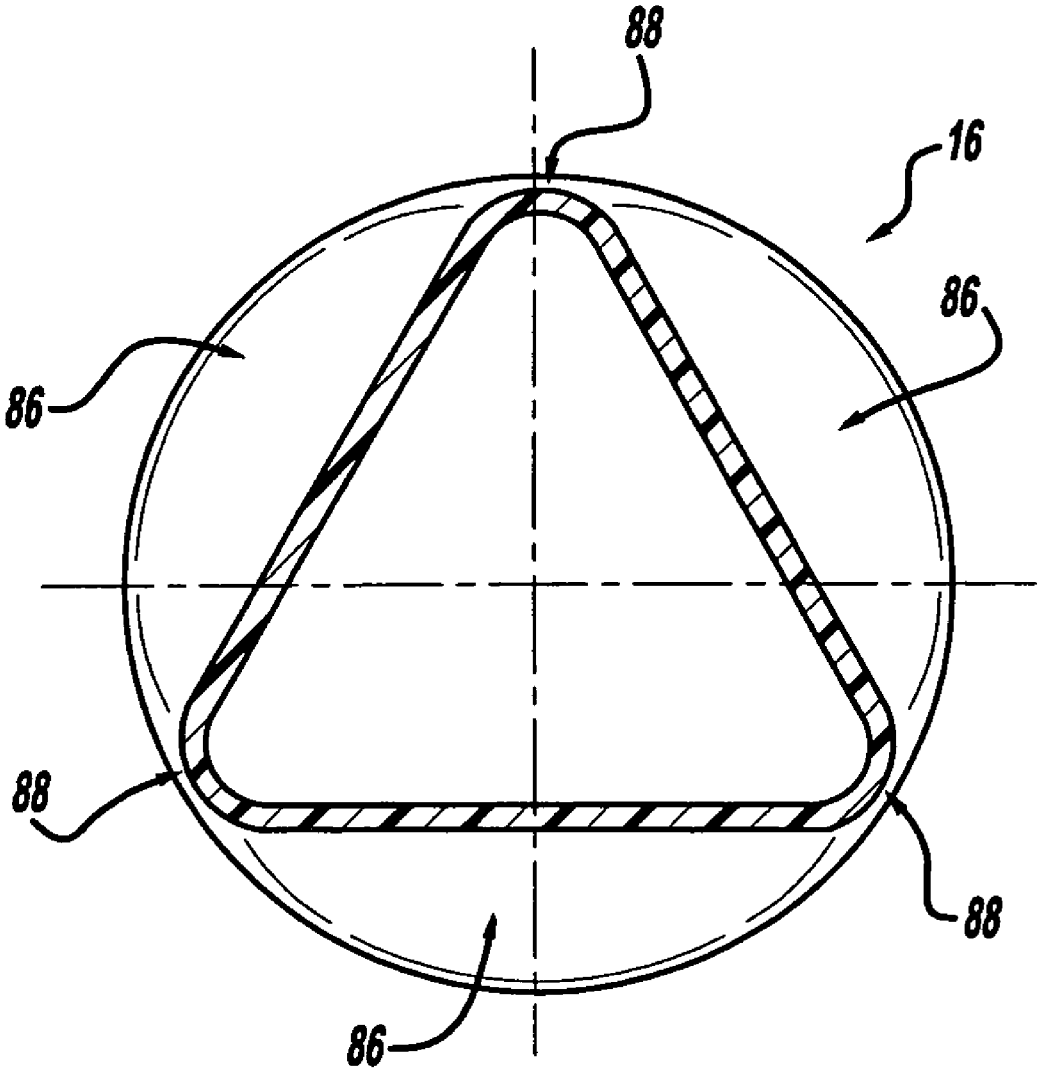
FIG. 7 is a cross-sectional view of the container taken generally along the line 7—7 of FIG. 6, the container being filled, sealed and under top load forces.

As illustrated in FIG. 3, in cross-section, the waist region 16 has a generally rounded triangular appearance. The construction of the waist region 16 creates and provides increased vertical strength to the container 10 by transferring top load forces throughout the container 10, thereby enhancing the top load strength capabilities of the container 10, by aiding in the prevention of creasing and buckling of the container 10 when subjected to top load forces. The generally rounded triangular appearance, in cross-section, of the waist region 16, allows the waist region 16 to collapse when subjected to excessive top load forces without significantly denting or deforming. As illustrated in FIG. 7, in cross-section, the waist region 16, when subjected to top load forces, takes on a more generally traditional triangular shaped appearance. Thereafter, once the excess top load forces have been removed, the waist region 16 of the container 10 "rebounds" and returns to its original, uncompromised position, function and appearance. Compare FIG. 3, the container 10 not subjected to top load forces with FIG. 7, the container 10 subjected to top load forces.

Upon filling with a hot product, capping, sealing and cooling, as illustrated in FIG. 6, and as further explained and described in commonly owned application Ser. No. 10/361,356, filed on Feb. 10, 2003, the entire disclosure of which is incorporated herein by reference, the vacuum panels 38 are controllably pulled radially inward, toward the central longitudinal axis 58 of the container 10, displacing volume, as a result of vacuum forces. The overall large dimension of the vacuum panels 38, approximately one-half (½) of the angular or circumferential extend of the container 10, facilitates the ability of the vacuum panels 38 to accommodate a significant amount of negative pressure or vacuum. Vacuum panels 38 are configured such that they absorb at least fifty percent (50%) of the negative pressure or vacuum, and preferably at least sixty percent (60%), and most preferably about seventy-five percent (75%) upon cooling. In other terms, vacuum panels 38 move radially inward in response to a vacuum related force created after filling, sealing and cooling container 10, so as to accommodate and alleviate a majority of that force.

Upon filling with a hot product, capping, sealing and cooling, as vacuum panels 38 are controllably pulled radially inward, toward the central longitudinal axis 58 of the container 10, the more rigid columns 40 slightly expand radially outwardly, away from the central longitudinal axis 58 of the container 10 providing a generally outward arcuate second convex shaped surface 94, as illustrated in FIG. 6.

Accordingly, the different arcuate sections of the sidewall portion 18 of the container 10 provide different functions. To this end, in response to hot filling, the vacuum panels 38 move radially inward in response to vacuum-induced volumetric shrinkage of the hot filled container 10, while the columns 40 resist deformation. Thus, the above described interaction between the vacuum panels 38 and the columns 40 significantly aids in the reduction and absorption of this negative pressure or vacuum. Thus, by inverting, the vacuum panels 38 accommodate a significant portion of the volumetric shrinkage without distorting the sidewall portion 18 of the container 10. The greater the inward radial movement of the vacuum panels 38, the greater the achievable displacement of volume. Deformation of the sidewall portion 18 of the container 10 is avoided by controlling and limiting the deformation of the vacuum panels 38. Accordingly, the thin, flexible vacuum panels 38 of the sidewall portion 18 of the container 10 allows for greater volume displacement versus containers having a semi-rigid sidewall.

Figure 8:
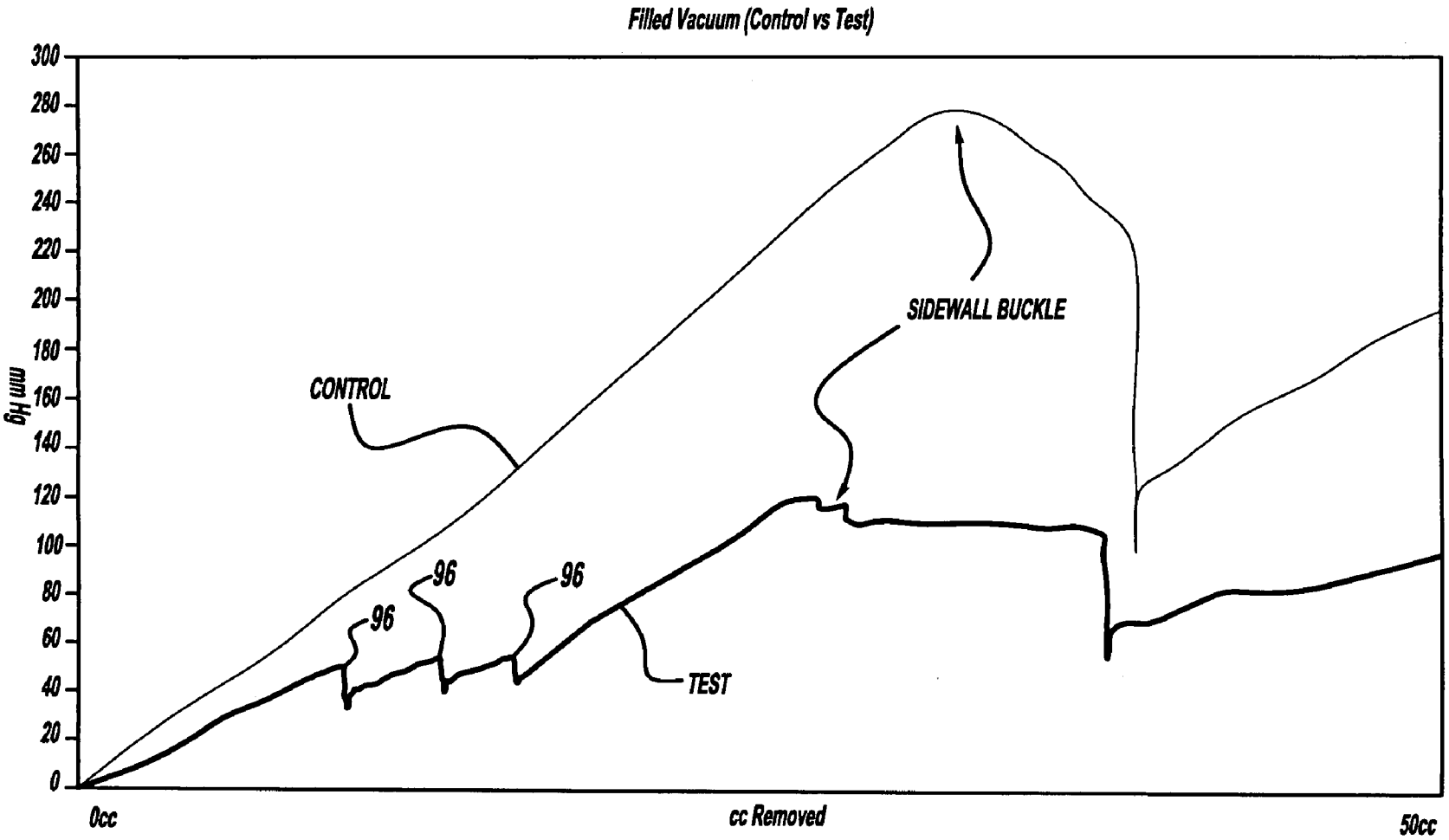
FIG. 8 is a graph comparing the vacuum pressures of a current stock container with that of a container embodying the principles of the present invention.

Referring now to the graph illustrated in FIG. 8, the significant benefit of the present invention through the reduction of negative pressure or vacuum is exhibited. As previously discussed, the less negative pressure or vacuum the container is subjected to, the greater the ability to lightweight the container. As illustrated, the current nominal twenty (20) fluid ounce stock control container, weighing approximately 38 grams, exhibits a maximum negative pressure or vacuum, prior to sidewall buckle, of approximately 280 mm Hg. While for the same amount of volume displacement, the container 10, having a nominal volume capacity of twenty (20) fluid ounces, weighing approximately 30 grams and having vacuum panels 38, exhibits a maximum negative pressure or vacuum, prior to sidewall buckle, of approximately 120 mm Hg. Accordingly, as is shown in FIG. 8, the container 10 having vacuum panels 38 can displace the same amount of volume as the current stock control container at a significantly lower negative pressure or vacuum thus allowing for the container 10 having vacuum panels 38 to be significantly lightweighted. The test data exhibited in FIG. 8 is associated with a container having three (3) vacuum panels 38. Each vacuum panel 38 offers a reduction in negative pressure or vacuum. The three (3) significant drops in negative pressure or vacuum from peaks 96 correspond to each vacuum panel 38 separately deflecting radially inward. As each vacuum panel 38 defects radially inward, the amount of negative pressure or vacuum is shown to drop significantly.

The novel and innovative construction of the container 10 provides for enhanced top load strength capabilities and creates "flex points" to increase resilience to top load forces. When subjected to excessive top load forces, the circumferential recess or annular groove 78 associated with the waist region 16, along with the upper circumferential recess or annular groove 60 and the lower circumferential recess or annular groove 62 of the sidewall portion 18, collapse or flex at certain flex points without failing, significantly denting or deforming. Thereafter, once the excessive top load force has been removed, the flex points associated with the circumferential recess or annular groove 78, the upper circumferential recess or annular groove 60 and the lower circumferential recess or annular groove 62 "rebound" and return to their original, uncompromised position, function and appearance without any negative impact on further container performance. The unique construction of the circumferential recess or annular groove 78 associated with the waist region 16, further promotes the transferring of top load forces throughout the container 10.

Figure 9:
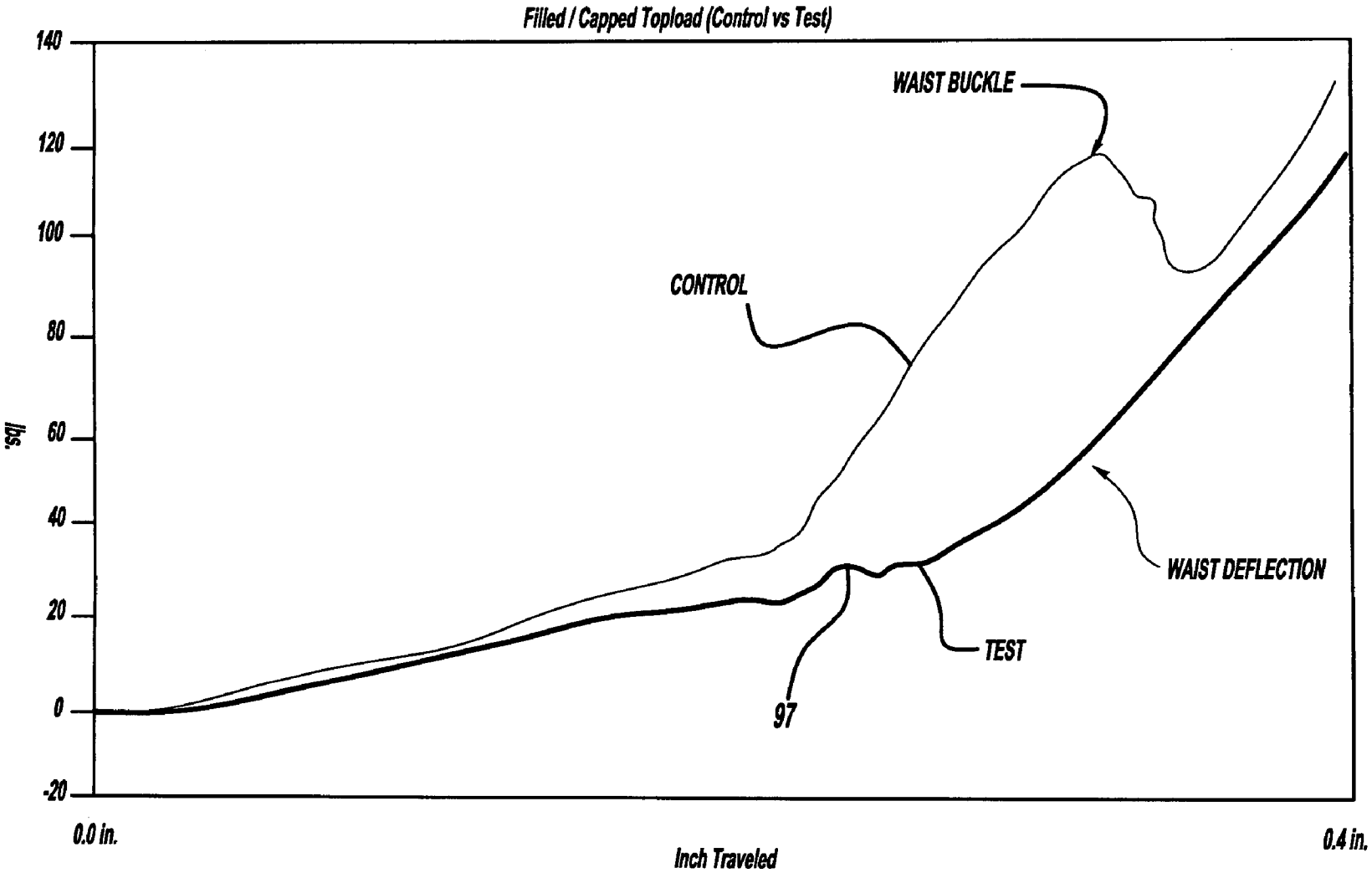
FIG. 9 is a graph comparing the top load force capabilities of a current stock container with that of a container embodying the principles of the present invention.

Referring now to the graph illustrated in FIG. 9, the benefit of the present invention through a significant relative increase in top load strength capabilities is exhibited keeping in mind that the stock control container weighs approximately 38 grams, while the test container 10 weighs approximately 30 grams. Both containers are hot filled to their nominal capacity and sealed. Those skilled in the art would expect the twenty (20) fluid ounce test container 10, which is significantly lighter in weight than the stock control container, to provide substantially poorer top load performance. Initially, the graph illustrated in FIG. 9 supports that expectation; however, once the waist buckles in the heavier control container, the top load performance drops significantly to that nearly the same as the lighter weight test container 10. On the other hand, the top load strength capability of the test container 10 shows a remarkably smooth transition relative to the control container. This smooth transition exhibited in the container 10 provides a significant advantage. In any warehousing situation, a double-stacked pallet having hundreds of containers, places a significant top load force on the containers found in the bottom pallet from the weight of the filled containers above. Unfortunately, containers exhibiting top load performance like that of the control container illustrated in FIG. 9, where the waist buckle causes a significant drop in performance, do not fail or buckle at the same time. Accordingly, some of the containers will buckle before others thus causing the double stack of pallets to become unstable and topple. Furthermore, even without toppling, the containers at the bottom will likely deform or dent permanently causing the containers to take-on an unsightly appearance when on the grocer's display shelf that in turn may cause consumers to avoid purchasing the product. On the other hand, the smooth transitional top load performance of the container 10 is less likely to become unstable and topple when stacked in a warehouse and less likely to cause any unsightly deformations or dents that would dissuade consumer purchases.

The above-described smooth transition is a result of several of the above-described features of the container 10 working together. One component of this smooth transition is the action of the vacuum panels 38 that invert and deflect radially inward as the container 10 reacts to vacuum related forces. When the container 10 is filled and sealed, application of top load forces causes pressure against the product contained within the container 10, which causes the inverted vacuum panels 38 to revert to their outward as formed position. A region 97 along the graph illustrated in FIG. 9 of the test container 10 shows the vacuum panels 38 reverting. With removal of the top load forces, the vacuum panels 38 return to their inverted or deflected radially inward position. Thus, the above-described similar feature working in opposite direction phenomenon increases the top load strength capabilities of the container 10. Accordingly, as illustrated, after the waist buckle of the stock control container, the heavier stock control container and the lighter test container 10, for the same relative amount of vertical displacement, withstand a similar amount of top load forces.

As mentioned above, the novel shape of the container 10 further lends itself to a significant amount of lighweighting. As compared to containers of similar volumetric sizes, shapes and types (see comparison set forth in Table 1 below), the container 10 generally realizes at least a ten percent (10%) reduction in weight and as much as a forty percent (40%) reduction in weight.

TABLE 1

| Container Portion | Commercial 20 Ounce Hot Fillable Container (Weight In Grams) | Container 10 (Weight In Grams) |
|---|---|---|
| Shoulder | 16.3 | 15.0 |
| Waist | 3.4 | 2.0 |
| Panel | 12.0 | 8.0 |
| Base | 6.4 | 4.5 |
| Total | 38.1 | 29.5 |

While the above description constitutes the preferred embodiment of the present invention, it will be appreciated that the invention is susceptible to modification, variation and change without departing from the proper scope and fair meaning of the accompanying claims.

What is claimed is:

1. A blow molded, biaxially oriented plastic container adapted for top load force enhancement and vacuum absorption, the container having an upper portion including a mouth defining an opening into the container, a lower portion forming a base, and a sidewall portion connected with and extending between said upper portion and said lower portion; said upper portion, said lower portion and said sidewall portion cooperating to define a receptacle chamber within the container into which product can be filled; said upper portion including a vertically modulating waist region; and said sidewall portion including a plurality of generally rectangular shaped vacuum panels and a plurality of columns formed therein, said vertically modulating waist region being movable to accommodate top load forces and said vacuum panels being movable to accommodate internal changes in pressure and volume in the container resulting from heating and cooling of its contents.

2. The container according to claim 1 wherein said vertically modulating waist region comprises a tri-global modulating annular groove.

3. The container according to claim 1 wherein said vertically modulating waist region comprises an annular groove extending circumferentially around the container having first radius portions and second radius portions.

4. The container according to claim 3 wherein said first radius portions are less than said second radius portions in dimension.

5. The container according to claim 4 wherein said first radius portions are aligned vertically with said columns and said second radius portions are aligned vertically with said vacuum panels.

6. The container according to claim 1 wherein said sidewall portion further includes a first annular groove extending circumferentially around the container adjacent to said vertically modulating waist region and a second annular groove extending circumferentially around the container adjacent to said base.

7. The container according to claim 6 wherein said first annular groove and said second annular groove include upper and lower plateaued portions, said upper plateaued portions being aligned vertically with said vacuum panels and said lower plateaued portions being aligned vertically with said columns.

8. The container according to claim 1 wherein said plurality of columns include a plurality of horizontal indents formed therein.

9. The container according to claim 1 wherein said vacuum panels move radially inward to accommodate internal changes in pressure and volume in the container resulting from heating and cooling of its contents, thereafter, when the container is subjected to top load forces, said vacuum panels revert to an original, as formed position.

10. A blow molded plastic container adapted for top load force enhancement and vacuum absorption, the container having an upper portion including a mouth defining an opening into the container, a lower portion forming a base, and a sidewall portion connected with and extending between said upper portion and said lower portion; said upper portion, said lower portion and said sidewall portion cooperating to define a receptacle chamber within the container into which product can be filled; said upper portion including a tri-global vertically modulating waist region; and said sidewall portion including a plurality of generally rectangular shaped vacuum panels and a plurality of columns formed therein, said columns forming a first generally convex shaped surface in cross section, said tri-global vertically modulating waist region being movable to accommodate top load forces and said vacuum panels being movable to accommodate vacuum forces generated within the container thereby decreasing the volume of the container.

11. The container according to claim 10 wherein said plurality of generally rectangular shaped vacuum panels comprise three vacuum panels and said plurality of columns comprise three columns, said vacuum panels and said columns being equidistantly spaced around the container.

12. The container according to claim 10 wherein said tri-global vertically modulating waist region comprises an annular groove extending circumferentially around the container having first radius portions and second radius portions, wherein said first radius portions are less than said second radius portions in dimension.

13. The container according to claim 12 wherein said first radius portions are aligned vertically with said columns and said second radius portions are aligned vertically with said vacuum panels.

14. The container according to claim 10 wherein said sidewall portion further includes a first annular groove extending circumferentially around the container adjacent to said tri-global vertically modulating waist region and a second annular groove extending circumferentially around the container adjacent to said base.

15. The container according to claim 14 wherein said first annular groove and said second annular groove include upper and lower plateaued portions, said upper plateaued portions being aligned vertically with said vacuum panels and said lower plateaued portions being aligned vertically with said columns.

16. A blow molded plastic container comprising:

an upper portion defining a mouth;

a shoulder portion formed with said upper portion and extending downward therefrom;

a vertically modulating waist region formed with said shoulder portion and extending downward therefrom;

a lower portion forming a base of the container; and a sidewall extending between and joining said vertically modulating waist region with said lower portion, said sidewall including a plurality of generally rectangular shaped vacuum panels and a plurality of columns formed therein, said vertically modulating waist region being movable along a vertical axis in response to top load forces, and said vacuum panels being inwardly movable along a radial axis, said movement being in response to internal changes in pressure and volume in the container resulting from heating and cooling of its contents.

17. The container according to claim 16 wherein said plurality of columns include a plurality of horizontal indents formed therein.

18. The container according to claim 16 wherein said plurality of generally rectangular shaped vacuum panels comprise three vacuum panels and said plurality of columns comprise three columns, said vacuum panels and said columns being equidistantly spaced around the container.

19. The container according to claim 16 wherein said vertically modulating waist region comprises an annular groove extending circumferentially around the container having first radius portions and second radius portions, wherein said first radius portions are less than said second radius portions in dimension.

20. The container according to claim 19 wherein said first radius portions are aligned vertically with said columns and said second radius portions are aligned vertically with said vacuum panels.

21. The container according to claim 16 wherein said sidewall portion further includes a first annular groove extending circumferentially around the container adjacent to said vertically modulating waist region and a second annular groove extending circumferentially around the container adjacent to said base.

22. The container according to claim 21 wherein said first annular groove and said second annular groove include upper and lower plateaued portions, said upper plateaued portions being aligned vertically with said vacuum panels and said lower plateaued portions being aligned vertically with said columns.

23. A blow molded, biaxially oriented plastic container adapted for top load force enhancement and vacuum absorption, the container having an upper portion including a mouth defining an opening into the container, a lower portion forming a base, and a sidewall portion connected with and extending between said upper portion and said lower portion; said upper portion, said lower portion and said sidewall portion cooperating to define a receptacle chamber within the container into which product can be filled; said upper portion including a modulating waist region, said modulating waist region including an annular groove extending circumferentially around the container having first radius portions and second radius portions, said first radius portions being less than said second radius portions in dimension, said first radius portions being aligned vertically with said columns and said second radius portions being aligned vertically with said vacuum panels; and said sidewall portion including a plurality of generally rectangular shaped vacuum panels and a plurality of columns formed therein, said modulating waist region being movable to accommodate top load forces and said vacuum panels being movable to accommodate internal changes in pressure and volume in the container resulting from heating and cooling of its contents.

* * * * *